United States Patent [19]

Lait

[11] Patent Number: 4,716,386

[45] Date of Patent: Dec. 29, 1987

[54] WAVEGUIDE TO STRIPLINE TRANSITION

[75] Inventor: Andrew J. Lait, Kanata, Canada

[73] Assignee: Canadian Marconi Company, Montreal, Canada

[21] Appl. No.: 872,676

[22] Filed: Jun. 10, 1986

[51] Int. Cl.[4] ..... H01P 5/107

[52] U.S. Cl. ..... 333/26; 333/248

[58] Field of Search ..... 333/21 R, 26, 248, 254

[56] References Cited

U.S. PATENT DOCUMENTS

| | | | |
|---|---|---|---|
| 3,140,342 | 7/1964 | Ehrreich et al. | 333/248 X |
| 3,201,725 | 8/1965 | Johnson | 333/254 |
| 3,732,508 | 5/1973 | Ito et al. . | |
| 3,882,396 | 5/1975 | Schneider | 333/21 R X |
| 3,924,204 | 12/1975 | Fache et al. . | |
| 3,932,823 | 1/1976 | Lavedan, Jr. et al. . | |
| 4,157,516 | 6/1979 | van de Grijp . | |
| 4,260,964 | 4/1981 | Saul . | |
| 4,453,142 | 6/1984 | Murphy | 333/26 |

FOREIGN PATENT DOCUMENTS

| | | | |
|---|---|---|---|
| 2402 | 1/1984 | Japan | 333/26 |

OTHER PUBLICATIONS

Howe, H. Jr., Stripline Circuit Design (Artech House, 1974), p. 40.

*Primary Examiner*—Paul Gensler

*Attorney, Agent, or Firm*—Fishman & Dionne

[57] ABSTRACT

The waveguide includes an input section and a short circuit section which each have a hollow interior of like size and shape enclosed by a surrounding wall. In arrangement, the input and short circuit section are in spaced alignment, and the stripline is interposed in the gap between the two sections. The stripline includes ground planes on either side thereof, and apertures are cut into the ground planes of the same size and shape as the hollow interiors, and, in arrangement, the apertures are in alignment with these hollow interiors. A wall of pins is disposed between the two sections whereby to simulate the continuation of the waveguide walls. The position of the transition may be arbitrarily chosen to suit the design of the stripline circuit.

8 Claims, 3 Drawing Figures

WAVEGUIDE TO STRIPLINE TRANSITION

BACKGROUND OF THE INVENTION

1. Field of the Invention

The invention relates to an arrangement for effecting a waveguide to stripline transition. More specifically, the invention relates to such an arrangement wherein a portion of the stripline is interposed in the space between an input waveguide section and an aligned short circuit waveguide section, and means are provided between the walls of the waveguide sections to simulate the continuation of the waveguide walls.

2. Description of Prior Art

Waveguide to stripline transitions are known in the art. Some are illustrated in, for example, U.S. Pat. No. 3,732,508, Ito et al, May 8, 1973, U.S. Pat. No. 3,924,204, Fache et al, Dec. 2, 1975, U.S. Pat. No. 3,932,823, Lavedan, Jr. et al, Jan. 13, 1976, U.S. Pat. No. 4,157,516, van de Grijp, June 5 1979, U.S. Pat. No. 4,260,964, Saul, Apr. 7, 1981 and Howe, H. Jr., Stripline Circuit Design (Artech House, 1974), p. 40. From these patents, and other prior art, it is known to extend a stripline into the interior of the waveguide to effect a waveguide to stripline transition. However, the striplines extend through a discontinuity in the waveguide walls which provides losses at the transition. Most of the cited references impose the limitation that the transition must be made at an end or edge of the stripline circuit.

None of the cited references teach the step of providing a simulation of the continuation of the waveguide walls.

SUMMARY OF THE INVENTION

It is therefore an object of the invention to provide a novel arrangement for effecting a waveguide to stripline transition.

It is a more specific object of the invention to provide such an arrangement which overcomes the problems of the prior art.

It is a still further object of the invention to provide such an arrangement which includes an input waveguide section and a short circuit waveguide section, means being provided between the waveguide sections for simulating the continuation of the walls of the waveguide.

In accordance with the invention, there is provided an arrangement for effecting a waveguide to stripline transition wherein a portion of the stripline is interposed in the space between the input waveguide section and an aligned short circuit waveguide section, and means are provided between the walls of the waveguide sections to simulate the continuation of the walls thereof.

Because the stripline section is perpendicular to the axis of the waveguide, the transition may be made at an arbitrary position on the stripline circuit, and is not limited to ends or edges.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
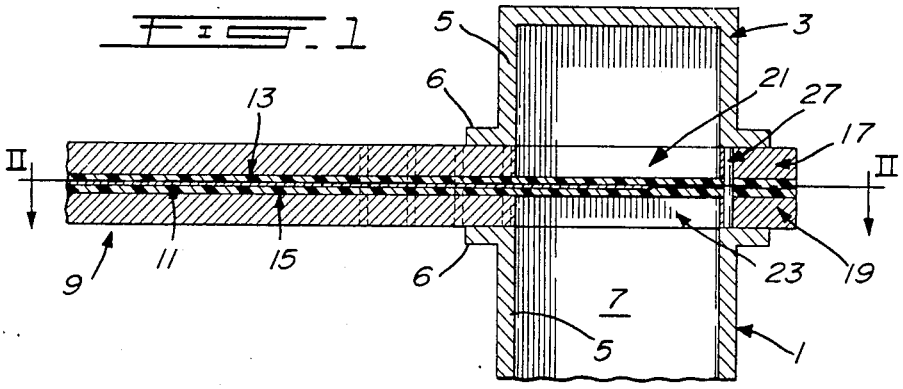
FIG. 1 is a cross-section of I—I of FIG. 2 and illustrates the arrangement in said view.
Figure 2:
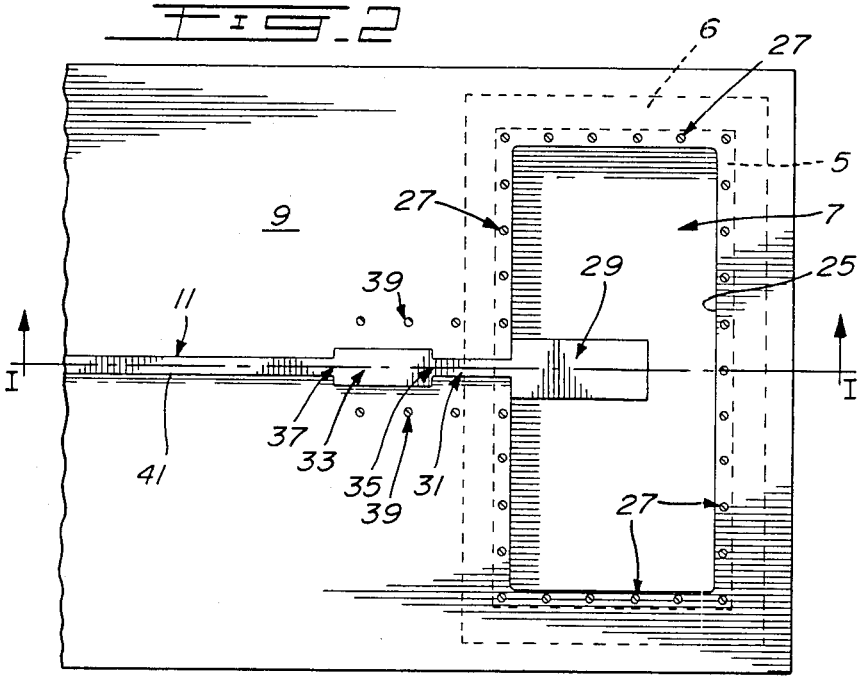
FIG. 2 is a cross-section through II—II of FIG. 1 and illustrates the arrangement in plan view.
Figure 3:
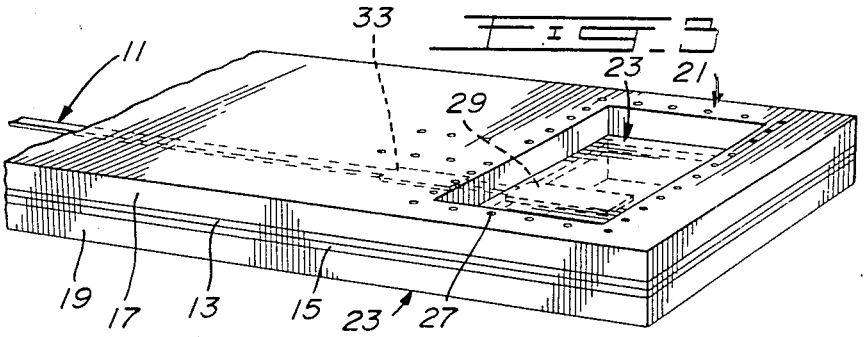
FIG. 3 is a perspective view of the stripline in accordance with the invention.

As seen in the drawings, the arrangement for effecting the transition comprises an input waveguide section 1 and a short circuit waveguide section 3. Walls 5 enclose a hollow interior 7 in both the input waveguide section and the short circuit waveguide section. As can be seen in FIGS. 1 and 2, the shape and size of the hollow interior of both the input waveguide section and the short circuit waveguide section are substantially identical, and, in arrangement, are in alignment with each other such that the hollow interiors of the both sections are aligned as are the surrounding walls.

The surrounding walls are usually rectangular in cross-section, and are illustrated as such in the drawings herein. However, it will be understood that the invention relates equally well to surrounding walls which are circular, or otherwise shaped, in cross-section.

The striplne, indicated generally at 9, comprises a copper track 11 sandwiched between dielectric boards 13 and 15. A first ground plane 17 is disposed on the surface of the dielectric plate 13 removed from the copper track, and a ground plane 19 is disposed on the surface of the dielectric plate 15 removed from the copper track. As can be seen, a cross-section surface of the short circuit section 3 is in contact with the ground plane 17, while the cross-section surface of the input waveguide 1 is in contact with the ground plane 19. An aperture 21 is cut into the ground plane 17 and an aperture 23 is cut into the ground plane 19. The apertures 21 and 23 are of the same size and shape as the hollow interiors of the waveguides, and are in alignment therewith. The size and shape of the hollow interior of the waveguides is defined by the inner wall 25 (see FIG. 2).

The drawings show the transition near the edge of the stripline circuit. While this position may be appropriate for many applications, it is not a restriction and the transition may be at an arbitrary position on the stripline circuit in the inventive arrangement.

Disposed between the walls 5 of the input waveguide section and the short circuit waveguide section are pins 27. As can be seen in FIG. 2, the pins 27 maintain the cross-sectional size and shape of the walls 5. As the pins are of a conductive material, the pins simulate the continuation of the walls 5 in the space between the input waveguide section and the short circuit waveguide section. Thus, the basic waveguide cross-section is maintained as it crosses the stripline.

In practice, these pins are set back slightly from the edges of the apertures 21 and 23 so that they can be supported by the dielectric plates and the ground planes and make good electrical contact with the ground planes. This slight increase in waveguide cross-section will cause a small mismatch, however, this can be compensated for by other aspects of the design of the transition.

The end of the copper track projects into the hollow interior of the waveguide to form a probe 29 which couples to the fields of the wave propagating along the waveguide. For wideband operation, and to allow the transition to work at moderate power levels, the probe will generally be considerably wider than the remainder of the copper track. If only a narrow band operation is required, it is possible to design a well matched transition by appropriate choice of probe length and the depth of the waveguide short circuit section. For wider bandwidths, from about 10% of midband frequency up to the full waveguide bandwidth, it will be necessary to add a matching section 33, connected to 29 by copper strip 31, to obtain required performance. The matching section 33 could comprise a quarterwave impedance transformer. However, capacitive or inductive stubs, could also be considered.

Although the corners of the hollow interior of the waveguides and the apertures are shown as sharp corners, the apertures 21 and 23 may have small radii at the corners for ease of machining. In addition, if the waveguide, particularly the short circuit section 3, is machined from solid metal, it will also probably have small radii in the corners. In any case, the major dimensions of the input waveguide 1, the short circuit section 3, and the aperturess 21 and 23 are the same. However, the shapes may differ in the nature of their corners. That is, the corners may be rounded or sharp. Accordingly, the shapes and sizes of the input waveguide 1, the short circuit section 3, and the apertures 21 and 23, while not necessarily completely identical, are nevertheless substantially identical.

The pins 27 extending through the dielectric and ground planes and maintaining the basic waveguide cross-section as it crosses the stripline circuit permit coupling between the waveguide and the stripline in a controlled manner without leakage to other parts of the stripline. The length of the pins should be such that they are held firmly in position, making good electrical contact, but do not extend beyond the outer surfaces of the ground planes and therefore do not interfere with the ends of the input waveguide or the waveguide short circuit section. A possible alternative to using pins would be to have through-plated holes in the dielectric around the edge of the waveguide cross-section. While plating holes in dielectric is a standard procedure, there could be difficulty in making good electrical contact between the plated holes in the two layers of dielectric and between the plating and the ground planes. It might be necessary to use plated lands at each end of the holes. While the lands touching the ground planes would not cause any interference, the lands at the interface of the two dielectric boards would change the effective waveguide cross-section. This would need to be accounted for in the design of the transition.

The copper track 11, sandwiched between the dielectric boards 13 and 15, may be printed and etched on one of the dielectric boards (it does not matter which one) while the other board has no metal layer on its inner surface (unless there are lands for through-plated holes). There may also be a thin adhesive layer between the dielectric boards.

The ground planes of the stripline may be formed by metallic plates 17 and 19 as illustrated in FIG. 1. Alternatively, the ground planes may be formed by metal layers on the outer surfaces of the dielectric boards, in which case the apertures 21 and 23 would have to be printed and etched from the metal layer. In some stripline constructions, the outer plates are omitted.

Although probe 29 is illustrated in Figure 2 as being rectangular in shape, this is not a necessity. Thus, the probe 29 could be tapered, parallel sided with a semicircular end, or rectangular with chamfers, or having small radii at the corners, or some other appropriate shape. As above-mentioned, although the waveguide and apertures are shown as having rectangular cross-sections, the invention is equally applicable to other waveguide sections, such as rectangular with radiussed corners, circular, elliptical, single-ridged or double-ridged.

The pins 27 form walls on all sides of the apertures 21 and 23, and the walls formed by the pins are in alignment with the surrounding walls 5 of the input waveguide section and the short circuit waveguide section.

As seen in FIG. 2, there is a gap in the wall of pins to permit the stripline track to enter the waveguide interior. Rows of pins 39, extending for a short distance along each side of the copper track, may be provided to reduce the possibility of coupling between the probe and other parts of the stripline circuit.

The tracks 31 and 41 will typically have a characteristic impedence of the order of 50 ohms.

Optimum dimensions for waveguide-to-coax and waveguide-to-stripline transitions are usually obtained experimentally for a required frequency band. An appropriate design procedure is to measure the impedance looking along the stripline (without matching section) toward the probe, with the waveguide input terminated by a well matched waveguide load, and with an adjustable depth waveguide short circuit at the other aperture. Sets of results can be obtained over the frequency band for various probe lengths and short circuit depths. For moderate bandwidths, the optimum depth of the short circuit will typically be about 0.12 to 0.15 of the mid-band guide wavelength, rather than the quarter-wavelength typical of the prior art. (See Howe, H. Jr., referred to above).

A set of dimensions which gives fairly constant amplitude of reflection coefficient over the frequency band offers scope for broadband matching by a quarter-wave section. The start of the matching section 33 may be located at a point 35 at which the resistive component of the impedance looking toward the probe is fairly constant over the frequency band, while the reactive components at the ends of the band have approximately equal amplitudes and opposite signs. These conditions and appropriate choice of characteristic impedance for the quarterwave section allow the resistive component of the impedance seen at the point 37, at the other end of the matching section 33, to be made approximately equal to the characteristic impedance of the line track 41. Point 35 may be chosen to give the value of the resistive component higher than the impedance of the track 11. In this case, the matching section 33 will have higher characteristic impedance than that of the track 11. At other positions for point 35, the value of the resistive component will be lower than the line impedance, and a lower impedance matching section will be required.

It is likely that one of these positions will give the best results, because the phase dispersion along the transmission line gives best compensation for variations in the reactive component of the impedance, and thus best overall impedance match.

If, however, there are two fairly equal solutions, one with a high impedance matching section, the other with a low impedance section, it would be better to select the lower impedance solution. This will have greater track width and can therefore be manufactured with better tolerance on the characteristic impedance of the matching section.

Although several embodiments have been described, this was for the purpose of illustrating, but not limiting, the invention. Various modifications, which will come readily to the mind of one skilled in the art, are within the scope of the invention as defined in the appended claims.

I claim:

1. An arrangement for effecting a waveguide to stripline transition, wherein:

said waveguide comprises an input waveguide section and a separate short circuit waveguide section;

said input waveguide section and separate short waveguide circuit section each section comprising a hollow interior of substantially the same size and shape enclosed by a surrounding wall;

said stripline comprising a copper track sandwiched between a first dielectric plate and a second dielectric plate;

a first ground plane on the surface of the first dielectric plate removed from said copper track, and a second ground plane on the surface of said second dielectric plate removed from said copper track;

said input waveguide section and said short circuit waveguide section being disposed in spaced alignment such that the surrounding walls and hollow interiors thereof are in alignment;

a portion of the stripline being disposed in the space between the input waveguide section and the short circuit waveguide section such that the first ground plane is in contact with the cross-sectional surface of the input waveguide section and the second ground plane is in contact with the cross-sectional surface of the short circuit waveguide section;

a first aperture in said first ground plane of substnatially the same size and shape as said hollow interior and a second aperture in the second ground plane of substantially the same size and shape as said hollow interior, the first and second apertures being in alignment with each other and being located in said portion of said stripline and in alignment with the hollow interiors of said input section and said short circuit section;

means disposed between the surrounding wall of said input section and the surrounding wall of said short circuit section to simulate a continuation of said waveguide walls, said means extending only between the outer surfaces of said first and second ground planes;

whereby to improve the match in the transition and to thereby reduce losses at the transition.

2. An arrangement as defined in claim 1 wherein said copper track comprises a first copper track portion extending into said hollow interior, said first copper track portion comprising a stripline probe.

3. An arrangement as defined in claim 2 wherein said copper track includes a second portion, disposed outside of said hollow interior, and comprising a matching section.

4. An arrangement as defined in claim 3 wherein said means disposed between said surrounding walls comprises a plurality of pins in alignment with said surrounding walls, whereby, said pins form a wall of pins in alignment with the surrounding walls of said input section and said short circuit section.

5. An arrangement as defined in claim 4 wherein said wall of pins comprises a gap permitting the copper track to extend into the interior of said waveguides, a second wall of pins formed on one side of said track and extending outwardly of said interior, and, a third wall of pins formed on the other side of said copper track and extending outwardly of said exterior of said waveguides, said second and third walls being of the same length.

6. An arrangement as defined in claim 5 wherein the depth of said short circuit section is between 0.12 and 0.15 of the mid-band guide wavelength.

7. An arrangement as defined in claim 6 wherein said matching section is interposed in the stripline track to improve the broadband match of the transition.

8. An arrangement as defined in claim 7 wherein said matching section comprises a quarterwave impedance transformer.

* * * * *

UNITED STATES PATENT AND TRADEMARK OFFICE

CERTIFICATE OF CORRECTION

PATENT NO. : 4,716,386

DATED : December 29, 1987

INVENTOR(S) : Andrew John Lait

It is certified that error appears in the above-identified patent and that said Letters Patent is hereby corrected as shown below:

Column 2, line 22, change "stripne" to --stripline--.

Column 3, line 17, change "aperturess" to --apertures--.

Column 4, line 15, change "impedence" to --impedance--.

Column 5, line 32 and 33 change "substnatially" to --substantially--.

Signed and Sealed this

Thirteenth Day of June, 1989

*Attest:*

*Attesting Officer*

DONALD J. QUIGG

*Commissioner of Patents and Trademarks*